US010016062B2

(12) United States Patent
Reynolds

(10) Patent No.: US 10,016,062 B2
(45) Date of Patent: Jul. 10, 2018

(54) DUAL-PURPOSE POLE CHAIR

(71) Applicant: Duane Reynolds, Avon, IN (US)

(72) Inventor: Duane Reynolds, Avon, IN (US)

( * ) Notice: Subject to any disclaimer, the term of this patent is extended or adjusted under 35 U.S.C. 154(b) by 31 days.

(21) Appl. No.: 15/346,800

(22) Filed: Nov. 9, 2016

(65) Prior Publication Data

US 2018/0014653 A1 Jan. 18, 2018

Related U.S. Application Data

(60) Provisional application No. 62/361,177, filed on Jul. 12, 2016.

(51) Int. Cl.

| | |
|---|---|
| ***A47C 1/12*** | (2006.01) |
| ***A47C 7/62*** | (2006.01) |
| ***A47C 7/00*** | (2006.01) |
| ***A47C 7/02*** | (2006.01) |
| ***A47C 9/10*** | (2006.01) |
| ***A47C 3/20*** | (2006.01) |

(52) U.S. Cl.

CPC ..... *A47C 7/62* (2013.01); *A47C 3/20* (2013.01); *A47C 7/004* (2013.01); *A47C 7/006* (2013.01); *A47C 7/02* (2013.01); *A47C 9/10* (2013.01)

(58) Field of Classification Search

CPC ..... A47C 7/62; A47C 7/004; A47C 7/006; A47C 7/02; A47C 7/002; A47C 3/20; A47C 3/28; A47C 3/30; A47C 3/40; A47C 9/10; A47C 9/00; A47C 9/007

USPC ..... 297/451.4, 451.5, 451.7, 451.13

See application file for complete search history.

(56) References Cited

U.S. PATENT DOCUMENTS

| | | | | |
|---|---|---|---|---|
| 3,542,326 | A * | 11/1970 | Reapsummer | A47C 1/023 248/416 |
| 4,657,218 | A * | 4/1987 | Scheberle | B60N 2/38 248/162.1 |
| 4,673,155 | A * | 6/1987 | Binder | A47C 3/30 108/147 |
| 5,238,013 | A | 8/1993 | Battiston et al. | |
| 5,673,966 | A * | 10/1997 | Morton, Jr. | A47C 9/10 297/195.11 |
| 6,893,097 | B1 * | 5/2005 | Ebensperger | A47C 9/10 297/16.2 |
| 7,070,241 | B2 * | 7/2006 | Saulnier | A47C 7/503 297/423.11 |
| 8,459,736 | B1 * | 6/2013 | Begley, Jr. | A47C 1/0265 297/217.7 |

(Continued)

FOREIGN PATENT DOCUMENTS

DE 9200169 U1 3/1992

OTHER PUBLICATIONS

Offhand Technique Reference Material, the Fuzzy Limey, www.rimfirecentral.com.

*Primary Examiner* — Mark R Wendell

(74) *Attorney, Agent, or Firm* — C. John Brannon; Brannon Sowers & Cracraft PC

(57) ABSTRACT

A dual-purpose pole chair and torso support apparatus including a seat portion, a rectangular base plate having four feet, and an elongated pole extending from the seat portion having a proximal end and an oppositely disposed distal end. The seat portion is connected to the proximal end of the pole, while the rectangular base plate is connected to the distal end of the pole. Both the seat portion and the rectangular base plate are connected to the pole via a quick release fastener system.

4 Claims, 12 Drawing Sheets

(56) References Cited

U.S. PATENT DOCUMENTS

| | | | | |
|---|---|---|---|---|
| 2006/0082203 | A1* | 4/2006 | Gasser | A47C 3/26 297/344.19 |
| 2007/0236053 | A1 | 10/2007 | West et al. | |
| 2011/0121619 | A1* | 5/2011 | Chappell | A47C 7/62 297/188.01 |
| 2011/0316313 | A1* | 12/2011 | Gasser | A47B 13/02 297/188.01 |
| 2012/0086252 | A1* | 4/2012 | Hong | A47C 3/30 297/344.21 |
| 2015/0289494 | A1* | 10/2015 | Davis | A01K 97/04 43/55 |
| 2017/0042334 | A1* | 2/2017 | Mengshoel | A47C 3/027 |
| 2017/0105530 | A1* | 4/2017 | Sheinkop | A47C 1/022 |
| 2017/0296003 | A1* | 10/2017 | Hoesman | A47K 3/122 |

* cited by examiner

DUAL-PURPOSE POLE CHAIR

CROSS-REFERENCE TO RELATED APPLICATIONS

This application claims the benefit under 35 U.S.C. § 119(e) to U.S. Provisional Patent Application No. 62/361,177, filed on Jul. 27, 2016, which is incorporated herein by reference in its entirety.

TECHNICAL FIELD

The present novel technology relates generally to the furniture industry, and, more particularly, to a travel-friendly, dual-purpose pole chair.

The details of one or more embodiments of the subject matter described in this specification are set forth in the accompanying drawings and the description below. Other features, aspects, and advantages of the subject matter will become apparent from the description, the drawings, and the claims.

BACKGROUND

Both domestically and worldwide, mobile or portable seating has been an important addition to the world of sports, camping, construction, hunting, and the like. More specifically, in the fields of auto repair and construction, many stools and chairs have been developed to fit the need of working on tasks located at or below waist level; however, when projects become too close to ground level, these stools cease to be useful and offer no assistance to the workman.

Thus, there is a need for a stool or chair that can, in addition to functioning as a traditional chair or stool, both provide support and assistance for completing tasks at or around waist level as well as yielding upper body support when working near ground level.

The present novel technology addresses these needs.

BRIEF DESCRIPTION OF THE DRAWINGS

Like reference numbers and designations in the various drawings indicate like elements.

DETAILED DESCRIPTION

Figure 1:
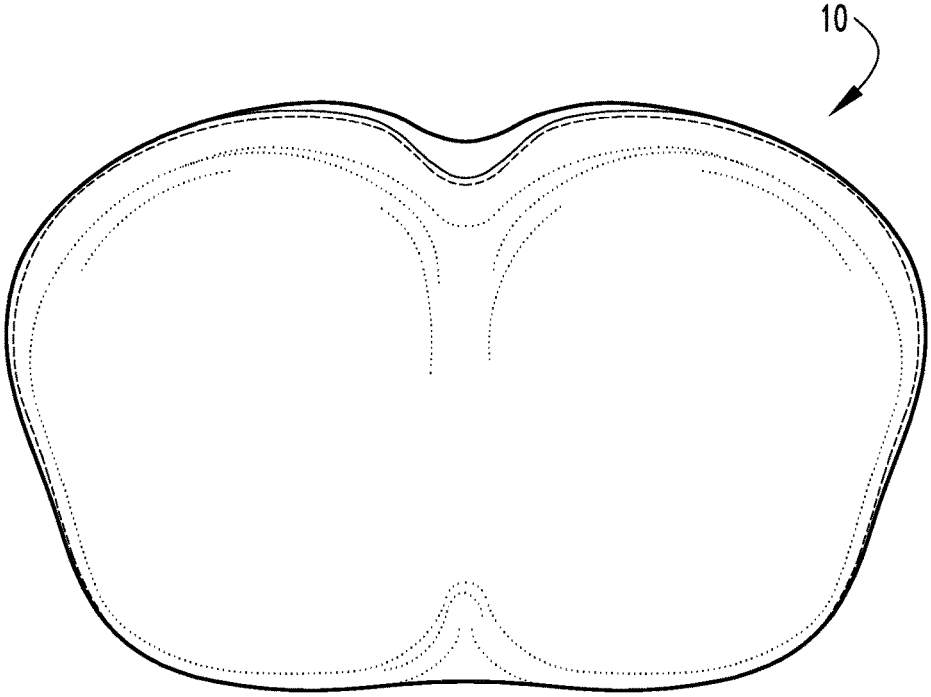
FIG. 1 is an enlarged partial view of one embodiment of the seat or cushion attachment of the present novel technology.
Figure 2:
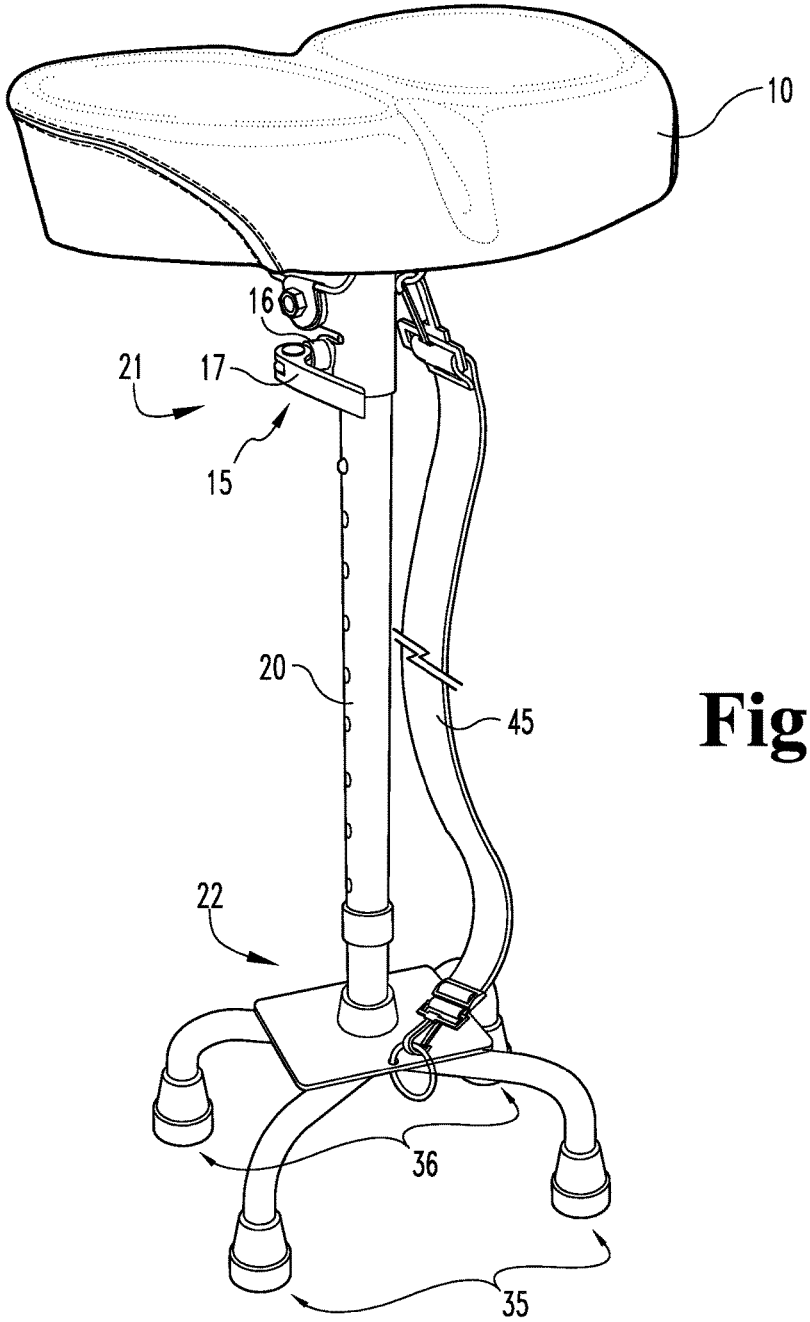
FIG. 2 is a perspective view of the embodiment of FIG. 2.
Figure 3:
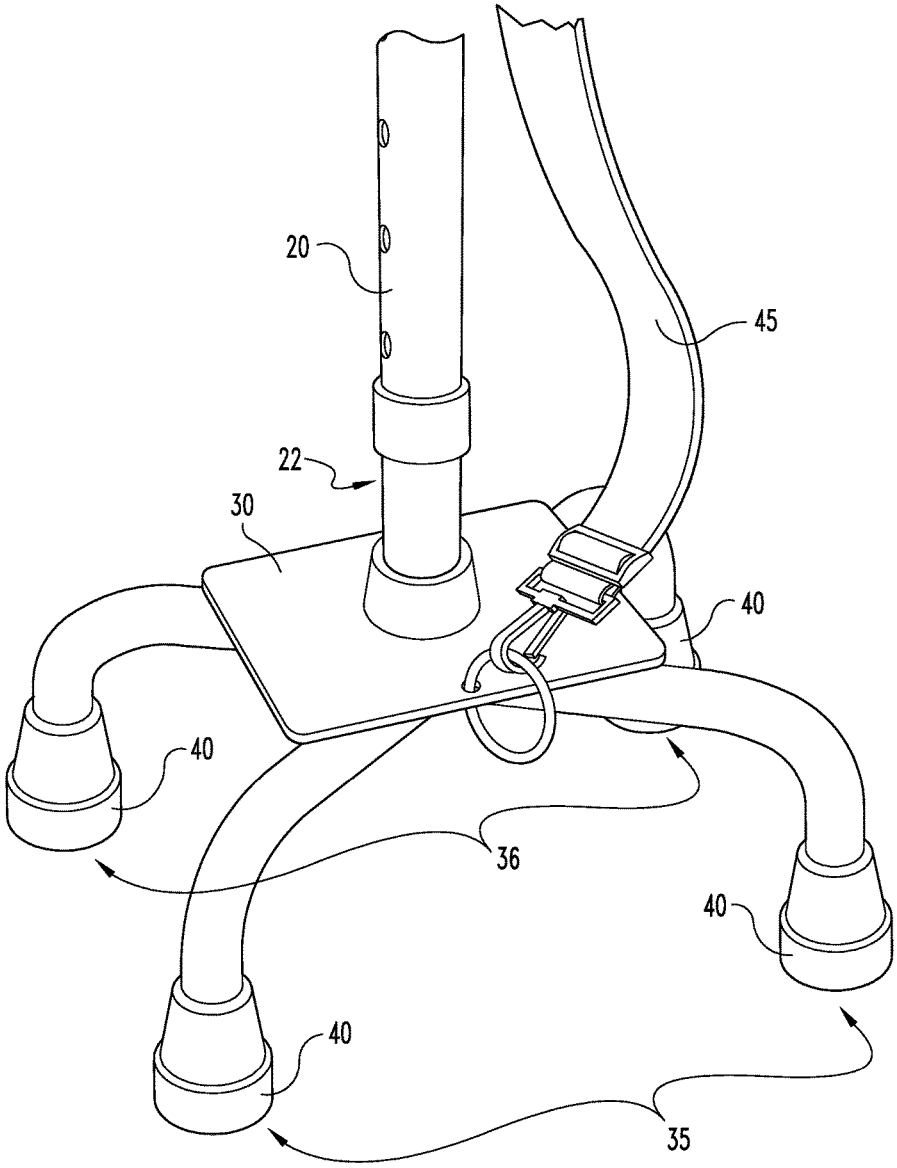
FIG. 3 is an enlarged partial view of the embodiment of FIG. 2.
Figure 4:
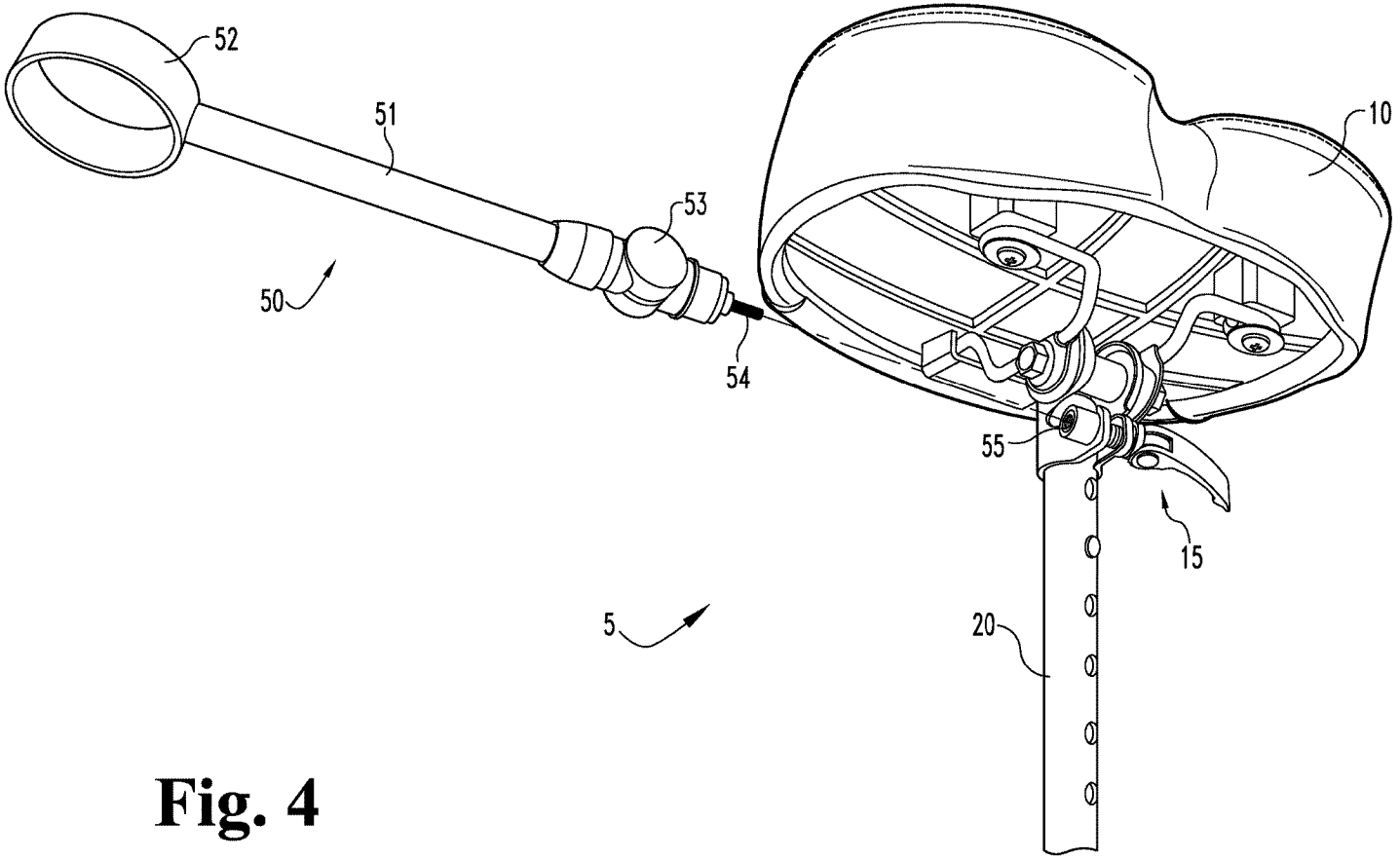
FIGS. 4 and 5 are perspective views of the embodiment of FIG. 2 with an attachment that is an extendable arm for holding objects.
Figure 5:
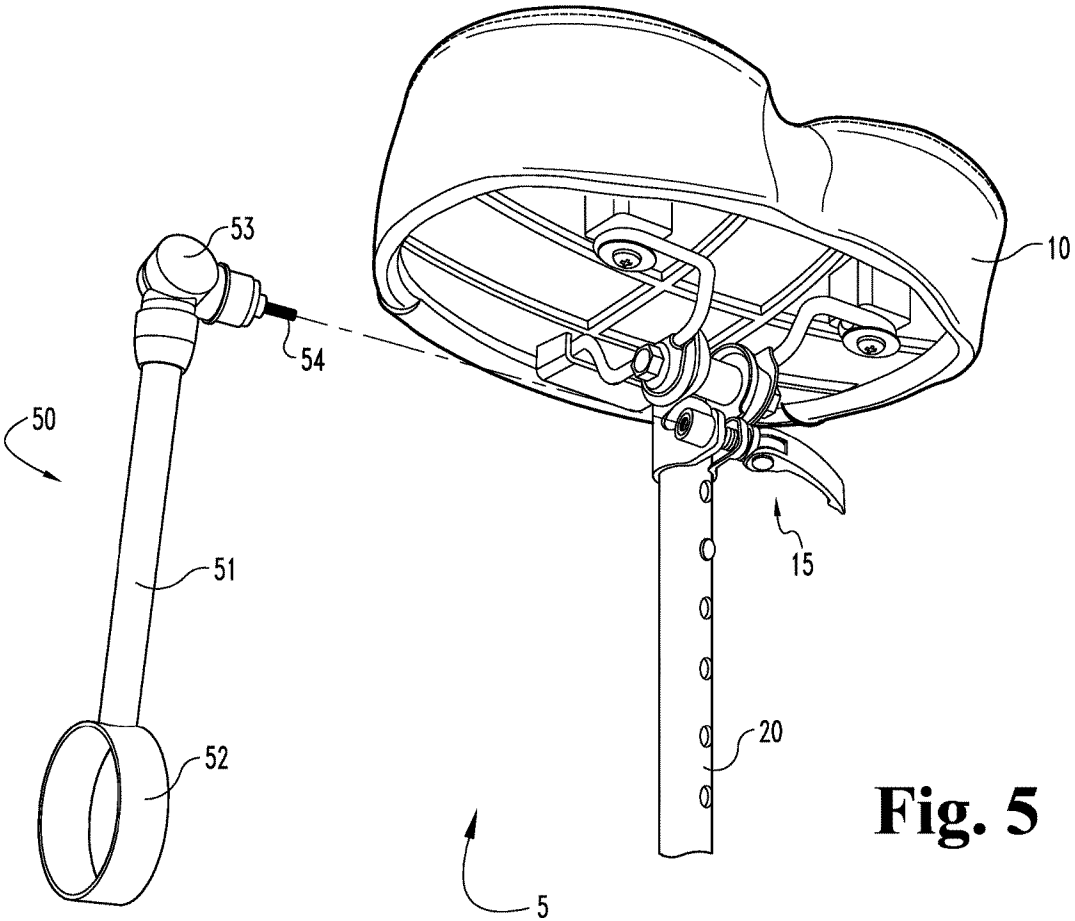
Figure 6:
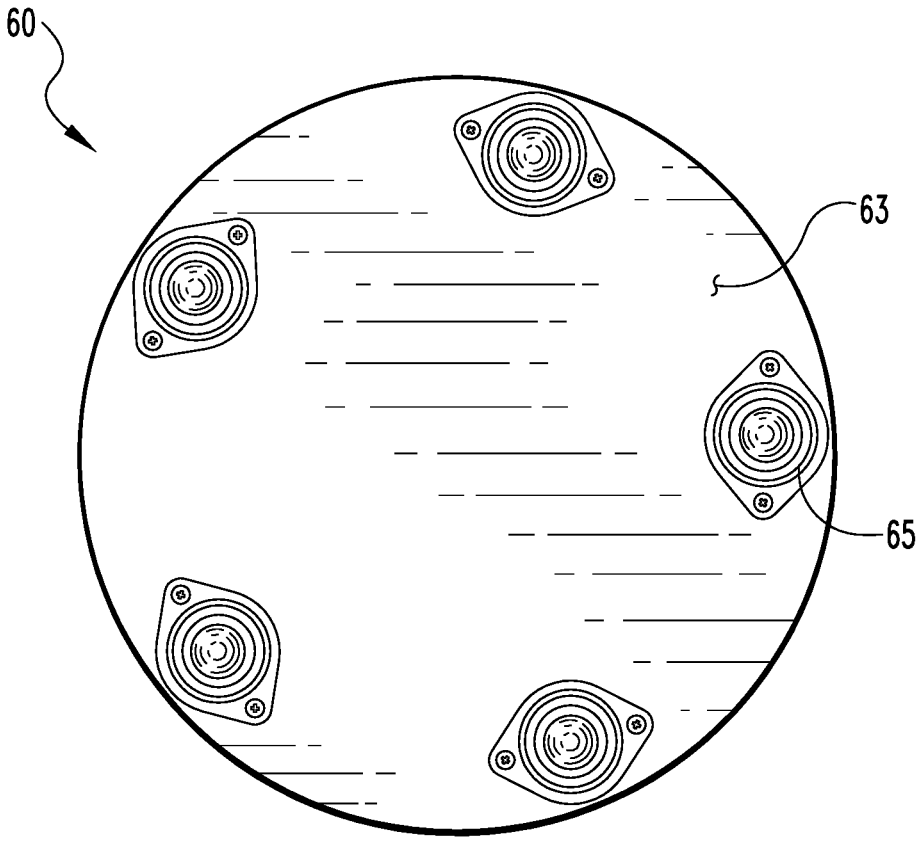
FIG. 6 is a perspective view of the embodiment of FIG. 2 with an attachment that is a baseplate with wheels on the bottom side.
Figure 7:
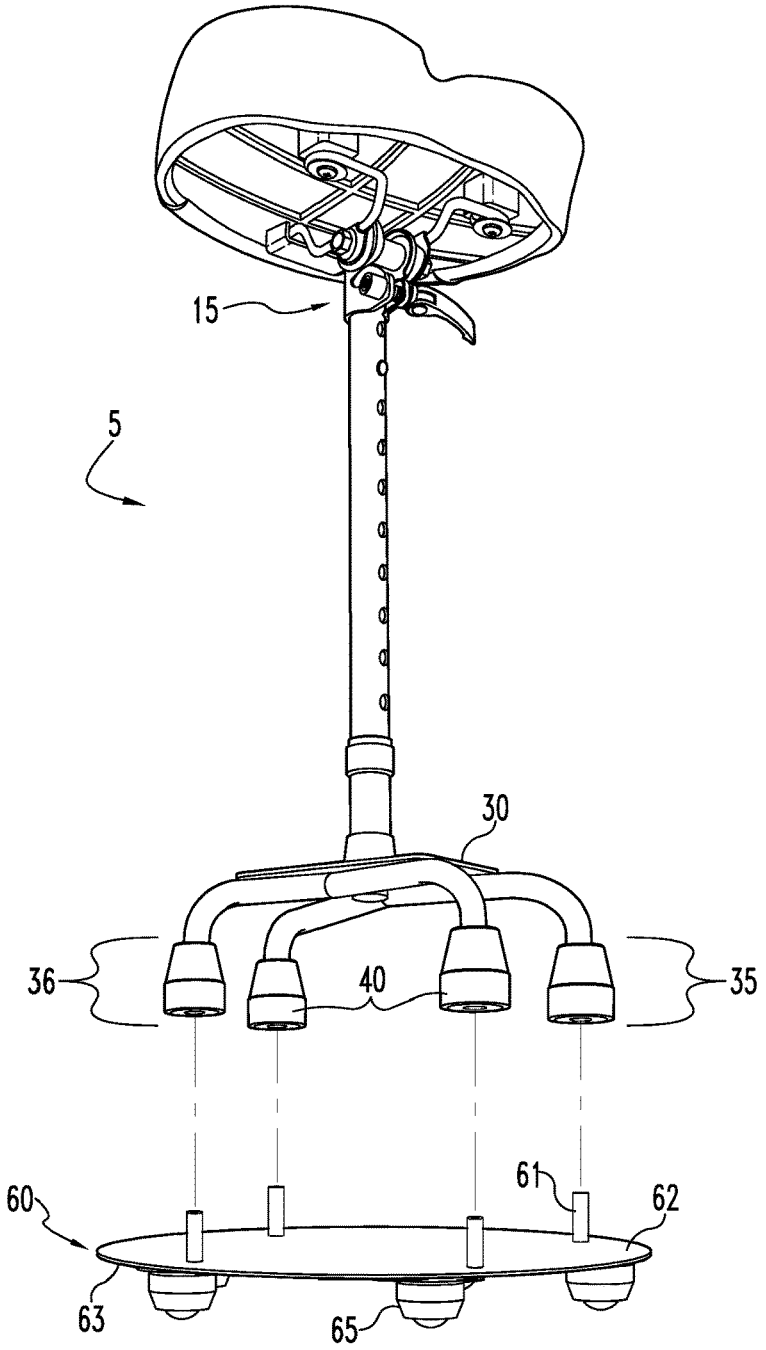
FIG. 7 is a perspective view of the opposite side of the embodiment of FIG. 6.
Figure 8:
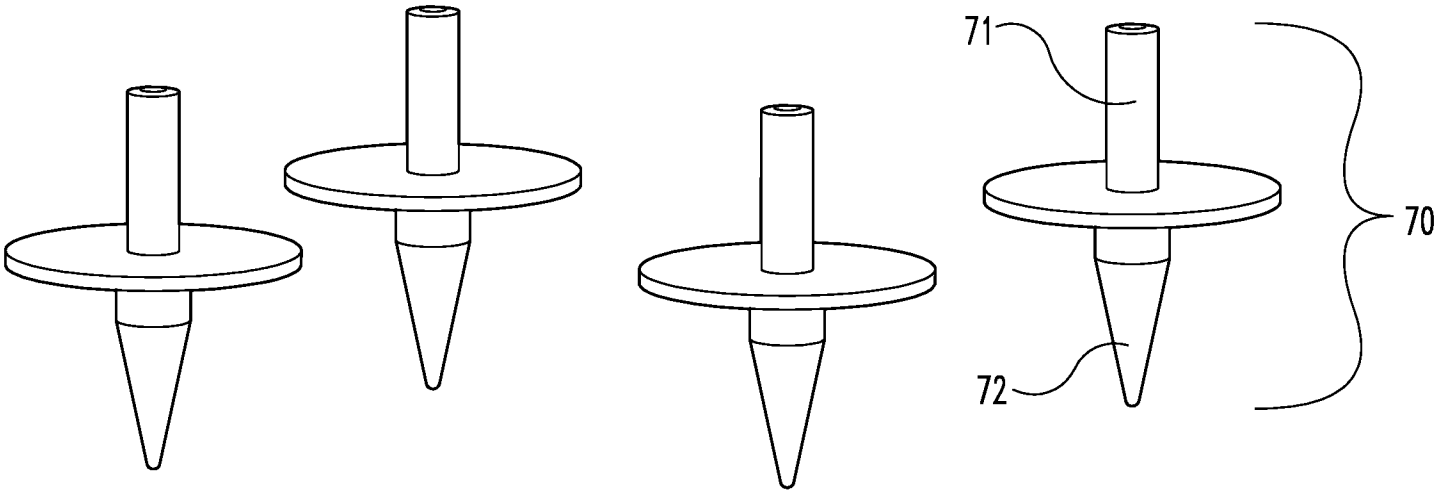
FIG. 8 is a perspective view of four shoe pieces associated with the embodiment of FIG. 2.
Figure 9:
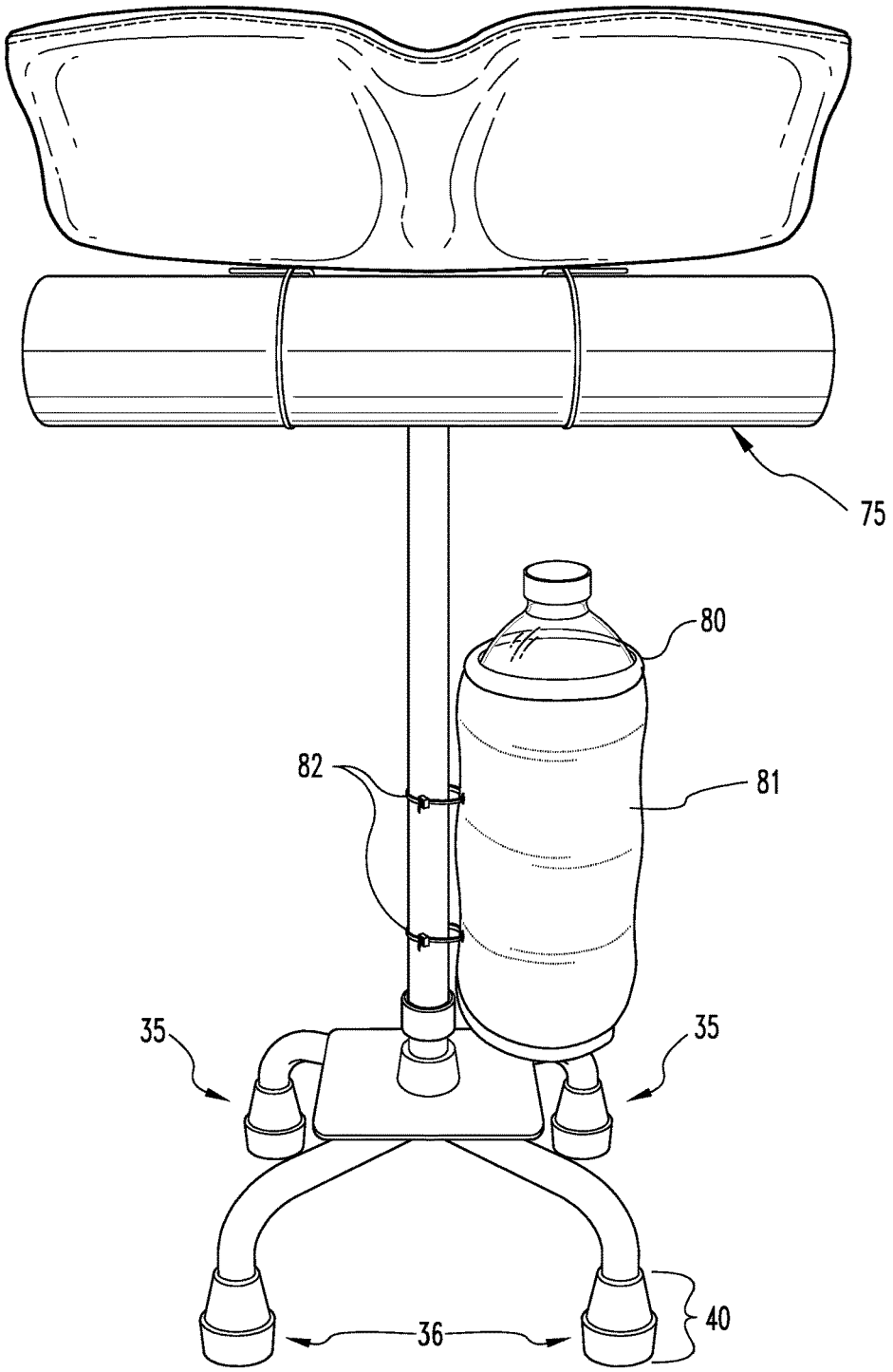
FIG. 9 is a perspective view of an attachment for the embodiment of FIG. 2 that holds an umbrella and an attachment that holds a water bottle.
Figure 10:
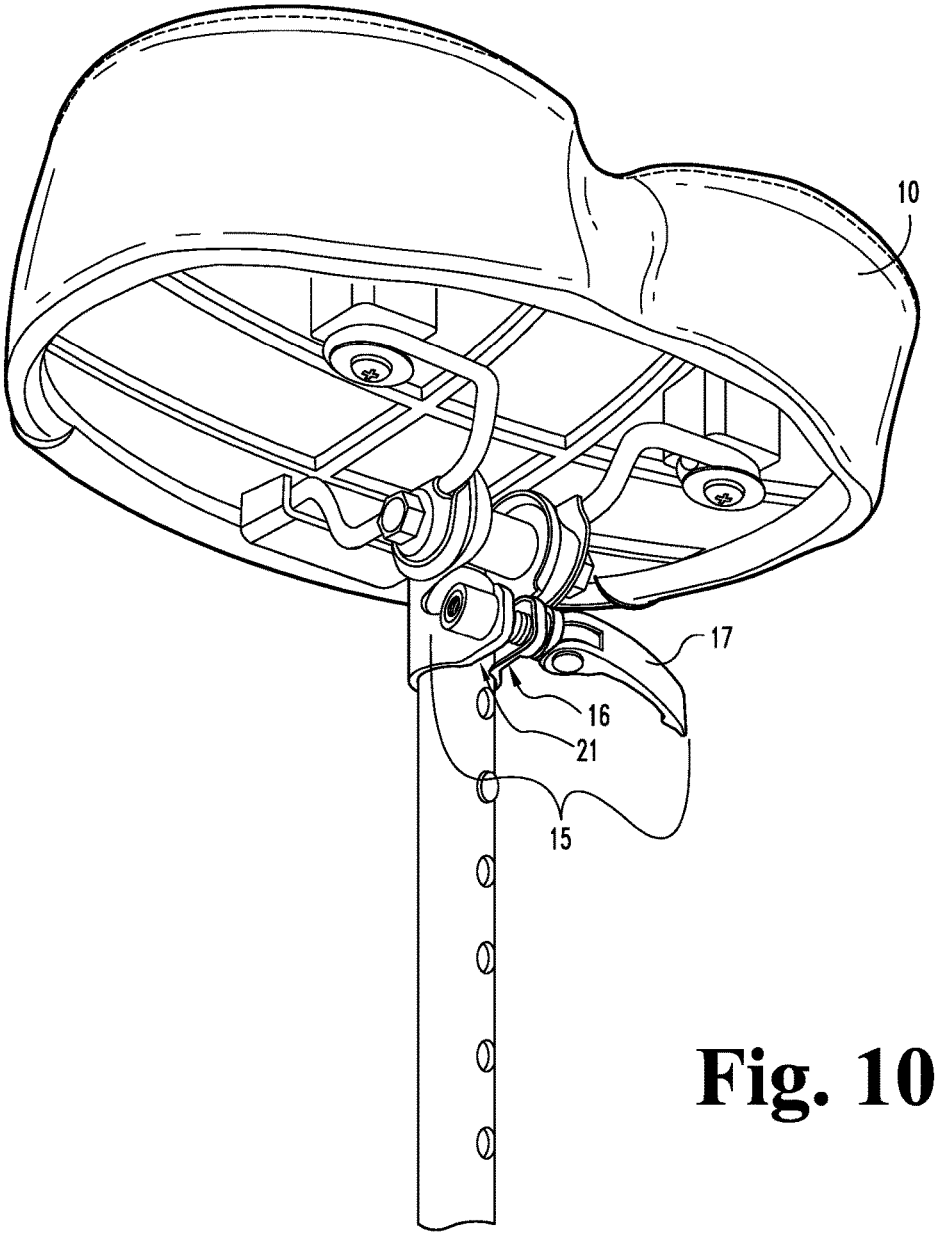
FIG. 10 is an enlarged partial view of the embodiment of FIG. 2 depicting seat, fastener system, and proximal end of pole.

For the purposes of promoting an understanding of the principles of the novel technology and presenting its currently understood best mode of operation, reference will now be made to the embodiments illustrated in the drawings and specific language will be used to describe the same. It will nevertheless be understood that no limitation of the scope of the novel technology is thereby intended, with such alterations and further modifications in the illustrated device and such further applications of the principles of the novel technology as illustrated therein being contemplated as would normally occur to one skilled in the art to which the novel technology relates.

The novel technology shown in FIGS. 1-12 illustrates a portable body support device or system 5 including a seat 10 or like support cushion, such as a bicycle seat or the like; a typically rectangular base plate 30, and elongated member or pole 20 having a proximal end 21 and an oppositely disposed distal end 22. The seat or cushion portion 10 typically may be attached to the proximal end 21 of the short elongated member or pole (typically about eighteen inches in length) 20 where the length of the elongated member 20 typically may be adjustable via a quick-release fastener system 15.

The opposite, distal end 22 typically may be attached to a typically rectangular base 30. The base 30 typically has two front feet 35 and two oppositely disposed rear feet 36 extending therefrom. In other implementations, base 30 may have a plurality of feet 35, 36, rather than only two per side and/or four total. Each respective foot 35, 36 typically has a cap 40 operationally connected thereto to increase traction with a given surface. The distal end 22 typically may not be centered relative to the base 30, but may instead typically be offset such that the pole 20 intersects the base 30 closer to the front feet 35 than to the rear feet 36. This base 30 may be firmly placed on a surface, such as the ground or floor, so that the user sits directly on the seat 10 with the base 30 underneath, typically with the user's feet likewise in ground contact.

The system 5 may further be used as a chest support by placing two of the feet 35, 36 against a wall and the opposing two feet 36, 35 on the ground, or by simply placing two feet 35, 36 on the ground, with the system 5 typically tilted toward the user. In this position, the user may engage their chest against the seat/cushion 10 and lean forward and extend his/her arms to an adjacent work area to complete tasks located close to ground level, such as carpentry finish work, electrician wiring tasks, and the like. This supportive positioning typically may help relieve stress on the lower back and knees that would normally be problematic for a user working on projects close to ground level.

Both the cushioned seat 10 and the rectangular base 30 of the chair 5 typically may be easily detached from the pole 20 for convenient storage and mobility, and different seats or cushions 10 may be connected to the pole 20 for different uses, such as cushions 10 tailored for sitting and other cushions 10 configured to provide chest support. All components 10, 20, 30 may typically fit comfortably into the saddlebag of a motorcycle and/or similarly sized storage space, making the dual-purpose pole chairs 5 convenient for hunting, camping, travelling, working, and/or the like. Additionally, because its parts 10, 20, 30 typically may be detachable, the compact nature of the pole chair 5 may not substantially add to the clutter of a contractor's tool inventory.

In some embodiments, the chair 5 may typically include multiple attachments. One such attachment may be shoulder strap 45 that typically connects under the seat 10 and extends to attach to the rectangular base plate 30, typically via a quick release fastener system 15 or the like. This typically may allow pole chair assembly 5 to be more easily transported.

The quick-release fastener system 15 typically may provide a clamp or like apparatus 16 for engaging the seat 10 and other attachments to the elongated member 20. The clamp 16 typically comprises a lever 17 that typically may be rotatably coupled to the (typically c-shaped) clamp 16. As the lever 17 is rotated clockwise the total circumference of the c-clamp 16 typically may be decreased and the clamp 16 may tighten around the attachment 10, 20, 30. Once the clamp 16 is substantially snug, the lever 17 may then be rotated so that it rests against c-clamp 16, which also typically further tightens the clamp 16.

Another attachment is an extendable arm assembly 50 for holding cups, beverages, and the like. The arm assembly 50 typically includes a curved or circular cup holder member 52 attached to an elongated member 51 that may be connected to the chair 5, typically just below the seat 10 of the chair 5 via quick-release fastener system 15, such as by insertion of pin 54 into receptor 55. In some implementations, holder member 52 may be substantially frustoconical in shape and/or size. The cup holder assembly 50 may be more typically connected via hinge 53 so that it may be pivoted down into an orientation parallel with the pole member 20 when not in use.

Another attachment may be circular base member 60 having a set of connectors or prongs 61 for receiving each of the foot caps 40 on one side (typically the top side 62) and wheels or castors 65 on the opposite side (typically the bottom side 63). The base member 60 may be attached by engaging the feet caps 40 snuggly with the prongs 61 on the top side 62 of the base member 60. This attachment 60 typically may allow the chair 5 to roll about when working on cars, motorcycles, carpentry tasks, and/or the like.

Another attachment includes four shoe pieces 70, each piece 70 respectively fitting onto each respective foot 35, 36 of the chair 5. On one side of each piece 70 typically may be a peg or like connector 71 matable with each foot cap 40, similar to prongs 61 found on the top side of the circular base member 60 described above, and on the other side may be spike 72. When these pieces 70 are attached to the respective feet caps 40, the chair 5 may be stuck or fastened firmly into grass, mud, sand, and/or like soft ground. This allows the chair 5 to be securely anchored to a great many surfaces.

Another attachment includes umbrella/umbrella holster 75, typically connected underneath seat/cushion 10. For example, umbrella holder 75 may connect to cushion 10 directly, seat 10 supports, via indirect attachment mechanisms (e.g., hook-and-loop material, adhesive, magnets, and/or the like). In other implementations, umbrella 75 may attach alternatively to fastener system 15, pole 20, base 30, and/or the like.

Another attachment includes water bottle attachment 80, typically connected to the elongated pole 20. The device consists of a sleeve 81 for holding the water bottle and two (typically elastic) straps 82 that attach the sleeve 81 to the pole 20. In other implementations, water bottle attachment 80 may attach alternatively to seat 10, fastener system 15, base 30, and/or the like.

Figure 11:
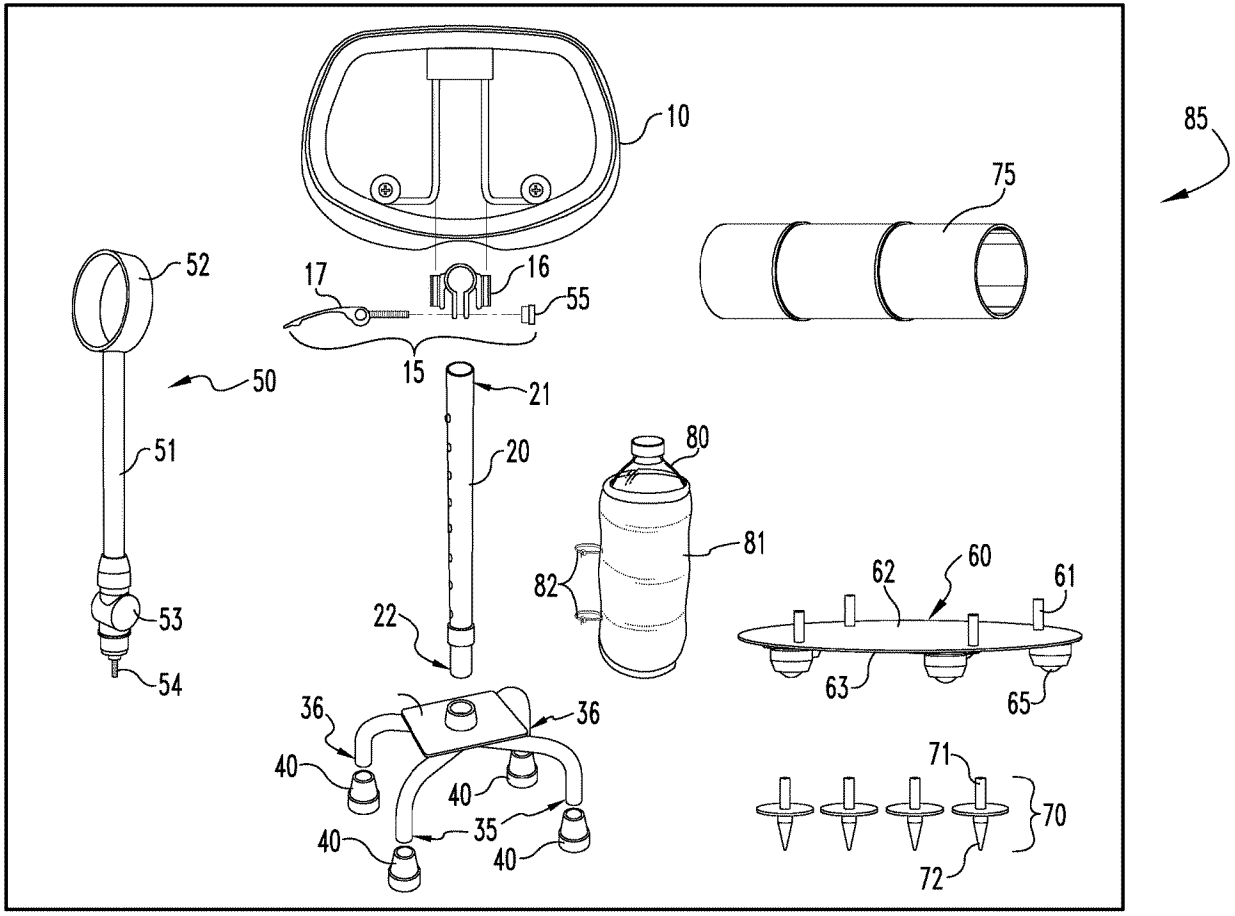
FIG. 11 is a diagram of a kit containing the present novel technology.
Figure 12:
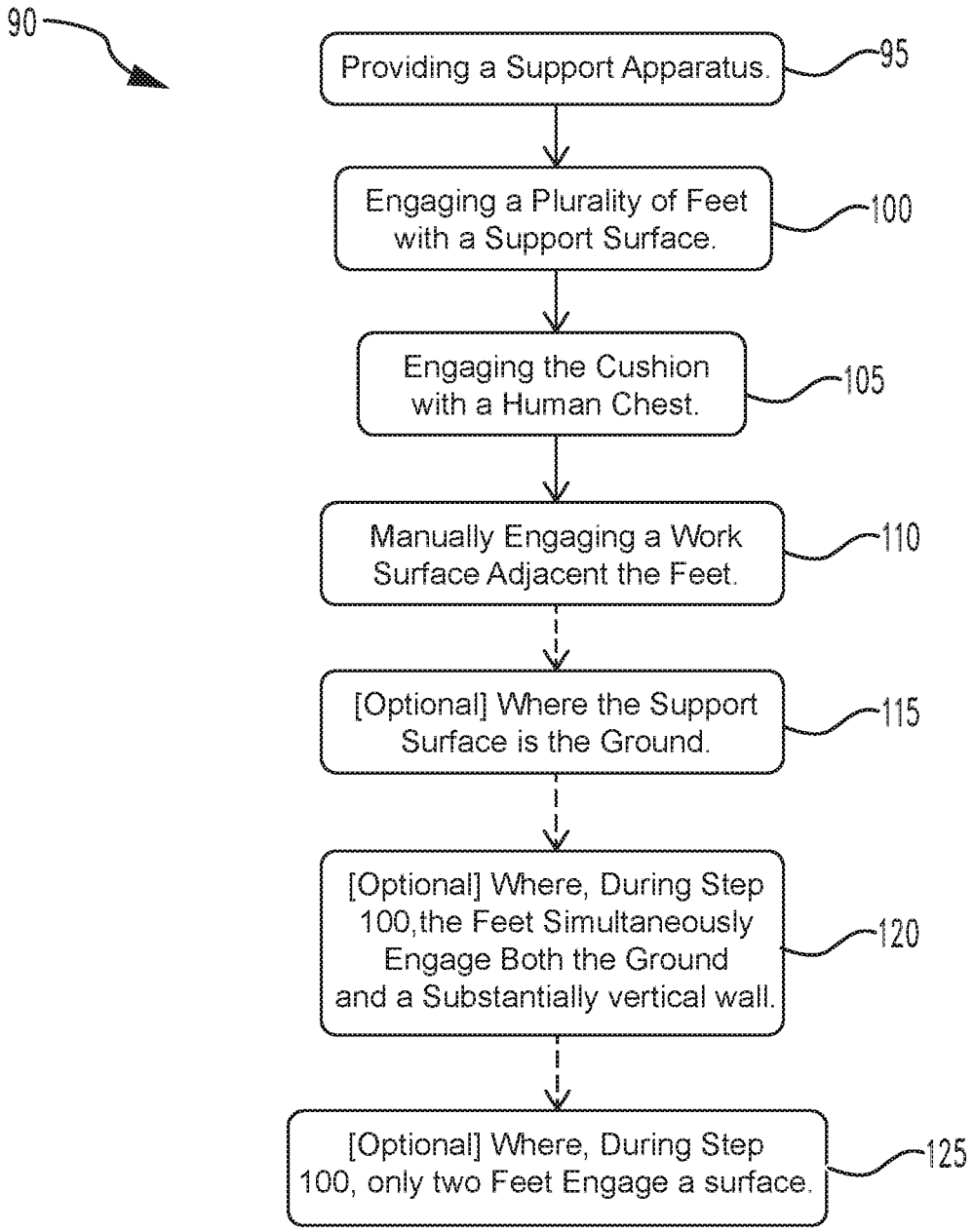
FIG. 12 is a process flow describing one example method of using the present novel technology.

Other embodiments and/or implementations of the present novel technology may be a kit 85 (e.g., as depicted in FIG. 11) and/or as a method 90 (e.g., providing a support apparatus).

One embodiment of a kit 85 may include, but is not limited to, seat 10, quick-release fastener system 15, clamp or like apparatus 16, lever 17, elongated member or pole 20 (typically having proximal end 21 and oppositely disposed distal end 22), typically rectangular base plate 30, a plurality of front feet 35 (more typically two front feet 35), a plurality of oppositely disposed rear feet 36 (more typically two rear feet 36), caps 40, shoulder straps 45, arm assembly 50 (typically including elongated member 51, cup holder member 52, and hinge 53), circular base member 60 (typically having first, top side 62 and second, oppositely disposed bottom side 63), connectors/prongs 61, shoe pieces 70, pegs/anchors 71, umbrella/umbrella holder 75, and/or water bottle holder 80 (typically including sleeve 81 and straps 82).

One non-limiting method 90 includes the steps of: providing a support apparatus 95; engaging a plurality of feet 100; engaging the cushion with a human chest 105; and manually engaging a work surface adjacent to the feet 110. Typically step 95 may provide but is not limited to a cushion portion 10, that is typically configured to provide torso support; a rectangular base plate 30 having four feet 35, 36 extending therefrom; a typically length-adjustable elongated pole 20 having a distal end 22 connected to the rectangular base portion 30, and having an oppositely disposed proximal end 21 operationally connected to the cushion portion 10, where the distal end 22 is uncentered relative to the rectangular base plate 30; and a fastener system 15 connected to the proximal end 21 and engaged with the seat 10.

One embodiment of step 110 may include but is not limited to an adjacent surface that is the ground 115. One embodiment of step 100 may include but is not limited to engaging both feet 35, 36 simultaneously with both the ground and a substantially vertical wall 120. Another embodiment of step 100 may include but is not limited to engaging only two feet 35, 36 with a surface 125.

In operation, a user may engage the front feet 35 with a ground surface or other like surface and the rear feet 36 with a wall or other like surface. The user may then lean or kneel down, and engage their chest with the seat portion 10. The user may then extend their arms out to an adjacent work surface. It may first be necessary to adjust the length of the elongated pole 20 given variable distances to different work surfaces.

In another embodiment, the user may engage only the front feet 35 or the rear feet 36 with a surface. This embodiment allows the entire device to pivot about the point of contact between either set of feet 35, 36 and the surface. This operation provides greater mobility for the user while still offering a stable, upper-body support.

Further implementations of methods may include variances such as where the surface is the ground, where the feet engage both the ground and a wall simultaneously, where only two feet engage a surface, and/or the like. Further, method steps may be repeated, omitted, subcycled, altered, and/or the like for desired outcomes. Additionally, the above example method is but a nonexclusive example and in no way limits uses of the present novel technology.

While the invention has been illustrated and described in detail in the drawings and foregoing description, the same is to be considered as illustrative and not restrictive in character. It is understood that the embodiments have been shown and described in the foregoing specification in satisfaction of the best mode and enablement requirements. It is understood that one of ordinary skill in the art could readily make a nigh-infinite number of insubstantial changes and modifications to the above-described embodiments and that it would be impractical to attempt to describe all such embodiment variations in the present specification. Accordingly, it is understood that all changes and modifications that come within the spirit of the invention are desired to be protected.

What is claimed is:

1. A dual purpose chair and torso support apparatus, comprising:

a seat portion;

a fastener system operationally connected to the seat portion;

an elongated pole extending from the seat portion and having a proximal end connected to the seat portion via the fastener system and an oppositely disposed distal end; and a rectangular base plate operationally connected to the distal end and having four feet extending therefrom;

wherein the seat portion is configured to provide torso support;

wherein the pole is length-adjustable; and wherein the distal end of the pole is not centered relative to the rectangular base plate; and a circular base member having a first, top side; a second, bottom, oppositely disposed side; and four prongs attached to the first side of the circular base member and extending therefrom configured to engage the four feet.

2. The device of claim 1 wherein the circular base member further comprises a plurality of wheels operationally connected to the second side of the circular base member.

3. A dual purpose chair and torso support apparatus, comprising:

a seat portion;

a fastener system operationally connected to the seat portion;

an elongated pole extending from the seat portion and having a proximal end connected to the seat portion via the fastener system and an oppositely disposed distal end; and a rectangular base plate operationally connected to the distal end and having four feet extending therefrom;

wherein the seat portion is configured to provide torso support;

wherein the pole is length-adjustable; and wherein the distal end of the pole is not centered relative to the rectangular base plate; and a plurality of spiked shoe pieces, each respective shoe piece attached to a respective foot.

4. A kit for a dual purpose chair and torso support apparatus, comprising:

an elongated pole having a proximal end and an oppositely disposed distal end;

a seat portion connectable to the proximal end of the pole;

a base plate having a plurality of feet extending therefrom and connectable to the distal end of the pole; and a quick-release fastener system connectable between the pole and to the seat portion; the kit further comprising a plurality of spiked shoe pieces, each respective spike shoe piece connectable to a respective foot.

* * * * *